US007435207B2

(12) United States Patent
Cook et al.

(10) Patent No.: US 7,435,207 B2
(45) Date of Patent: Oct. 14, 2008

(54) COLLAPSIBLE AND STORABLE APPARATUS FOR EXERCISING CORE MUSCLES

(75) Inventors: John W. Cook, 2837 Forest View Dr., Akron, OH (US) 44333; Matthew A. Heinle, 1035 Poulsen Dr., Akron, OH (US) 44313; Detlev F. Smith, Fairlawn, OH (US)

(73) Assignees: John W. Cook, Akron, OH (US); Matthew A. Heinle, Akron, OH (US)

( * ) Notice: Subject to any disclaimer, the term of this patent is extended or adjusted under 35 U.S.C. 154(b) by 0 days.

(21) Appl. No.: 11/712,186

(22) Filed: Feb. 28, 2007

(65) Prior Publication Data

US 2008/0207414 A1 Aug. 28, 2008

(51) Int. Cl.
*A63B 26/00* (2006.01)

(52) U.S. Cl. ..... 482/142; 297/58

(58) Field of Classification Search ..... 482/142; 297/354.13, 377, 124, 362.1, 58, 461, 16.1; 108/118–120; 248/164, 432
See application file for complete search history.

(56) References Cited

U.S. PATENT DOCUMENTS 3,074,716 A * 1/1963 Mitchel et al. ..... 482/56
5,356,359 A * 10/1994 Simmons ..... 482/97
6,491,607 B2 * 12/2002 Simmons et al. ..... 482/93
2007/0054787 A1 * 3/2007 Simmons ..... 482/97
2007/0277709 A1 * 12/2007 Carter ..... 108/115

* cited by examiner

*Primary Examiner*—Lori Amerson
(74) *Attorney, Agent, or Firm*—Renner, Kenner Greive, Bobak, Taylor & Weber

(57) ABSTRACT

A core muscle exercising apparatus has a support platform that is held off the ground in an operative position by opposed front support legs and opposed rear support legs. A front support leg on one side of the apparatus is pivotally secured to a rear support leg on that same side, and a front support leg on the other side of the apparatus is pivotally secured to the rear support leg on that side. In the operative position, the front support legs hold the support platform in an operative position, generally parallel to a ground surface on which the front and rear support legs stand. In a storable position, the front support legs are pivoted relative to the rear support legs on their respective pivot assemblies, and the support platform further pivots toward the front support legs to provide the apparatus in a collapsed, readily storable position.

5 Claims, 5 Drawing Sheets

COLLAPSIBLE AND STORABLE APPARATUS FOR EXERCISING CORE MUSCLES

FIELD OF THE INVENTION

This invention relates to improvements in apparatus for exercising core muscles of the body, including the abdominals, hamstrings, and lower back. More particularly, this invention relates to a collapsible and storable apparatus that is conducive to use in the home.

BACKGROUND OF THE INVENTION

The importance of maintaining strong core muscles for general fitness and the prevention of injuries is well known. Well conditioned core muscle groups, such as the abdominals, the hamstrings and the lower back muscles, not only provide one with a slim and fit overall appearance, but can also contribute to better balance and posture and increased overall body strength. Development of the core muscles can also help one in overcoming lower back pain. This has been well known for years, but undue emphasis has been placed on working the abdominals only, as can be appreciated by considering all of the home-based exercise apparatus that target the abdominals, from "crunch" exercise apparatus to torso-twisting apparatus and many others. In the case of treating back pain and injury, working the abdominals without working other core muscles can lead to an muscle imbalance that can create additional problems for the lower back. Nevertheless, these apparatus are fairly popular despite their narrow focus on developing the abdominals because they are compact and storable and are perceived as providing a good work out for core muscle groups.

The present invention addresses the need for developing strong core muscles for general overall fitness and, in particular instances, for the prevention of and rehabilitation from back muscle and cartilage injuries, particularly in the lower lumbar region of the back. Particularly useful exercise methods and apparatus for this purpose are disclosed in U.S. Pat. Nos. 5,356,359 and 6,491,607, and they have been successfully used in many exercise gyms and rehabilitation centers. However, the apparatus disclosed therein are significantly permanent structures demanding dedicated space for their use, and are thus not suitable for use in the home or in other settings where it is impractical to permanently dedicate space to an exercise apparatus of substantial size.

This invention seeks to address the need for a more complete core muscle work out particularly in the home environment and other areas where space cannot be dedicated to the more permanent and substantial core muscle apparatus of the prior art. Thus, this invention addresses the need in the art for a collapsible and storable apparatus for exercising the core muscles of the body, particularly including the abdominals, hamstrings, and lower back.

SUMMARY OF THE INVENTION

This invention provides a core muscle exercise apparatus. The apparatus includes a support platform, supported by first and second pairs of support legs. The support platform has a top support surface extending between opposed sidewalls and having a front end and rear end. Each of the opposed sidewalls has a support groove extending from a front groove end to a rear groove end. The first pair of opposed support legs are associated at support ends thereof with the support grooves provided in the opposed sidewalls, such that the support ends of the first pair of opposed support legs can move relative to the opposed sidewalls, from the front groove ends of the support grooves to the rear groove ends of the support grooves. The first pair of opposed support legs extend from the support ends to foot portions thereof. The second pair of opposed support legs each have a support end associated with a respective one of the opposed sidewalls of the support platform through a support platform pivot assembly. The second pair of opposed support legs can pivot at the support platform pivot assemblies relative to the support platform, and the second pair of opposed support legs extending from the support ends to foot portions thereof. The first pair of opposed support legs are pivotally secured to the second pair of opposed support legs at pivot assemblies provided between the support ends and the foot portions of the first and second pairs of opposed support legs. A pendulum assembly is pivotally secured to the support platform proximate a rear end thereof. The pendulum assembly includes a pendulum arm and at least one pad assembly. The support platform, the first pair of opposed support legs and the second pair of opposed support legs are engaged for manipulation to selectively assume an operative position and a collapsed, storable position.

In accordance with a particular embodiment, in the operative position, the support ends of the first pair of opposed support legs are secured to the support platform proximate the front groove end of the support groove and the foot portions of the first pair of opposed support legs engage a ground surface. The foot portions of the second pair of opposed support legs engage the ground surface, and the top surface of the support platform is held substantially horizontal to the ground surface. In this embodiment, the support platform includes opposed storage grooves in its opposed sidewalls, and, in the collapsed, storable position, the support ends of the first pair of opposed support legs are positioned at the rear groove end of the support groove. The support platform is pivoted at the support platform pivot assemblies to rest the support platform on the second pair of support legs, with the pivot assemblies provided between the support ends and the foot portions of the first and second pairs of opposed support legs being received in the opposed storage grooves of the support platform.

BRIEF DESCRIPTION OF THE DRAWINGS

The best mode contemplated in carrying out this invention is illustrated and disclosed with reference to the following detailed description and accompanying drawings wherein.

DETAILED DESCRIPTION OF THE PREFERRED EMBODIMENT

Figure 1:
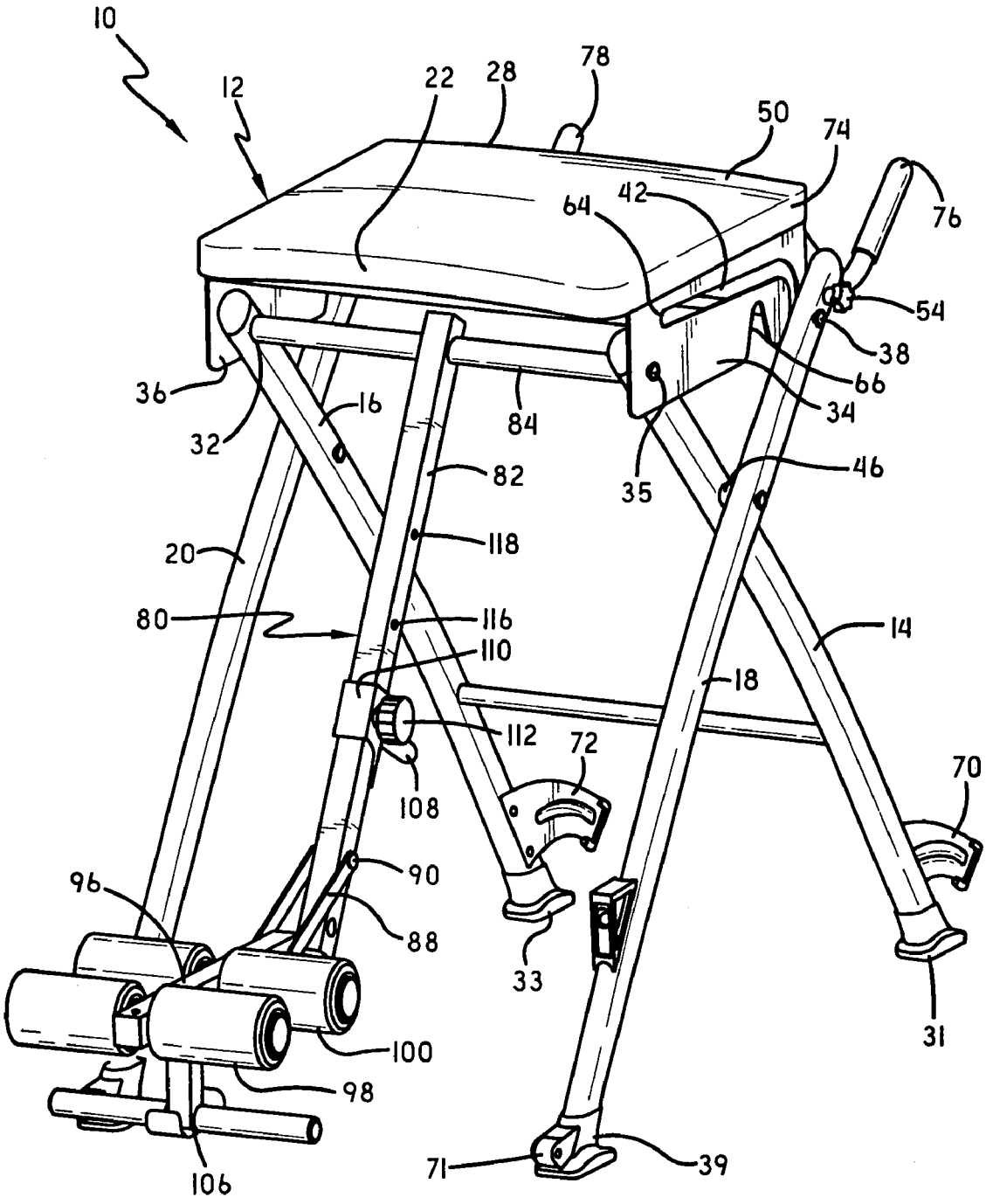
FIG. 1 is a perspective view of the core muscle apparatus of this invention, shown in an operative position.
Figure 2:
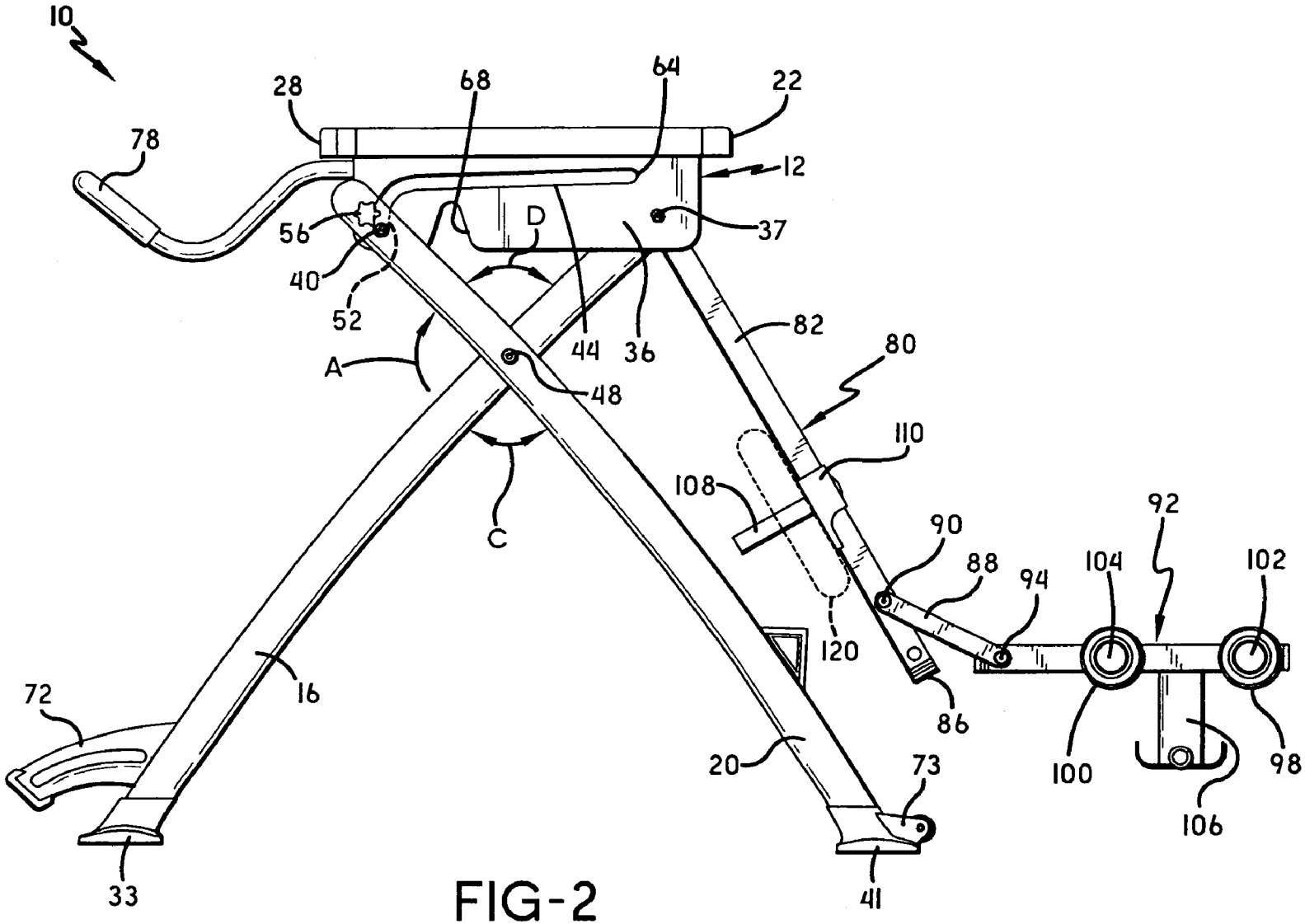
FIG. 2 is a side elevation of the core muscle apparatus.
Figure 3:
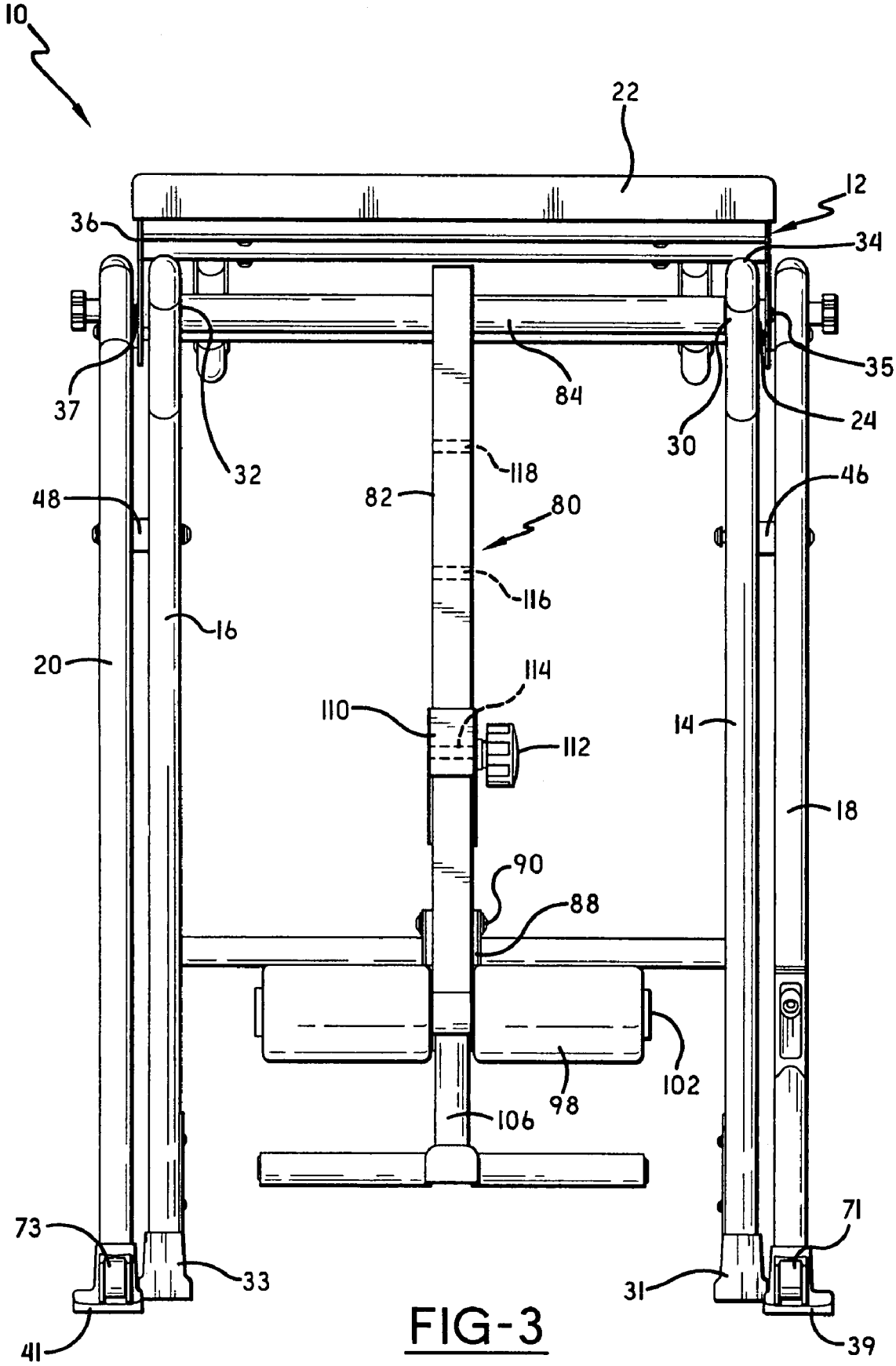
FIG. 3 is rear elevation of the core muscle apparatus.
Figure 4:
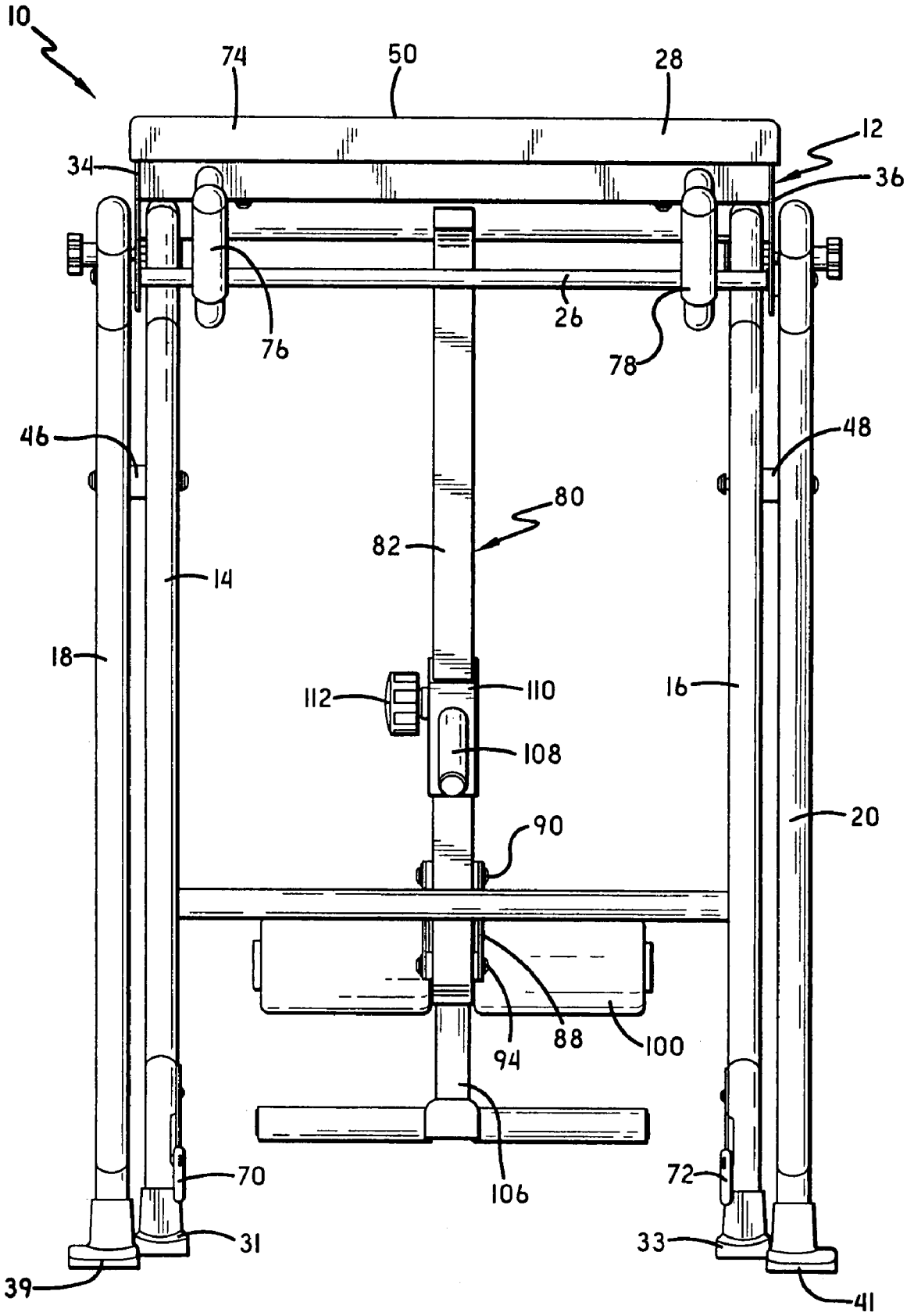
FIG. 4 is a front elevation of the core muscle apparatus.

With reference to FIGS. 1-4, it can be seen that a core muscle apparatus in accordance with this invention is shown and designated by the numeral 10. The core muscle apparatus 10 includes a support platform 12 supported by opposed rear support legs 14 and 16 and opposed front support legs 18 and 20. The opposed rear support legs 14, 16 are designated as "rear support" legs because they secure to support platform 12 proximate the rear edge 22 thereof, at rear support cross arm 24 (FIG. 3). The opposed front support legs 18, 20 are designated as "front support" legs because, in the operative position, as shown in FIGS. 1-4, the front support cross arm 26 (FIG. 4) to which they are secured is positioned proximate the front edge 28 of support platform 12.

The rear support cross arm 24 is secured between the opposed side walls 34, 36 of the support platform 12, at support platform pivot assemblies 35, 37. The opposed rear support legs 14, 16 pivot about the rear support cross arm 24 at their respective support end pivot assemblies 30, 32 to support the apparatus 10 at foot portions 31, 33 engaging the floor. The front support cross arm 26 is pivotally secured to both the opposed front support legs 18, 20, and extends through the opposed support grooves 42, 44 in side walls 34, 36 of the support platform 12. The opposed front support legs 18, 20 pivot about the front support cross arm 26 at their respective support end pivot assemblies 38, 40, to support the apparatus 10 at foot portions 39, 41. The rear support leg 14 is secured to the front support leg 18 at a pivot assembly 46, and the rear support leg 16 is secured to the front support leg 20 at a pivot assembly 48. Considering the structure explained hereinabove, it should be appreciated that the front support legs 18, 20 can pivot in the direction of arrow A, from the operative position shown in FIG. 2 to the collapsed storable position shown in FIG. 5. This is explained more fully below.

While it will be appreciated that various pivoting points of connection (i.e. pivot assemblies) herein could simply consist of cross supports inserted through holes in the appropriate structures, they preferably involve some type of bearing as generally known in the art. This should be understood for all pivoting points of connection in the apparatus 10, described above and herein below.

Figure 5:
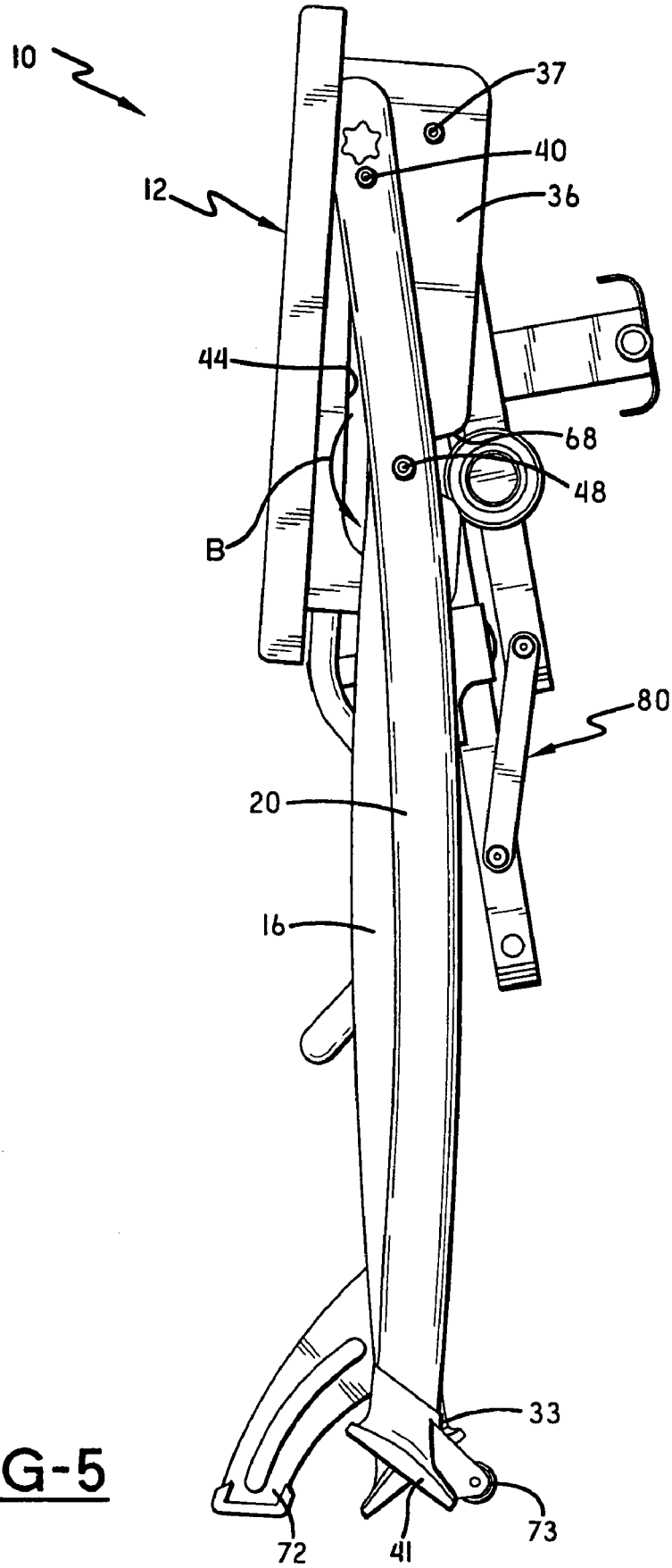
FIG. 5 is a side view of the core muscle apparatus, shown in a collapsed, storage position.

In the operative position shown in FIG. 2, the rear support legs 14, 16 extend from their support end pivot assemblies 30, 32 to contact the floor at foot portions 31, 33, which are positioned outside of the footprint of the top surface 50 of the support platform 12. It will be appreciated that the "footprint" of the support platform 12 is defined by the side walls 34, 36 and the rear edge 22 and front edge 28. The front support legs 18, 20 extend from their support end pivot assemblies 38, 40 to their foot portions 39, 41, which extend outside of the footprint of the support platform 12. With reference to FIGS. 2 and 5, it should be appreciated that the operative position of FIG. 2 is reached by pivoting the front support legs 18, 20 in the direction of arrow B, with the front support cross arm 26 forced to move through the opposed support grooves 42, 44. When the front support cross arm 26 reaches the front end 52 of the opposed grooves 42, 44, the support platform 12 is held substantially horizontal to a ground surface on which foot portions 31, 33 and 39, 41 rest. When the apparatus 10 is being used, an individual will have much of their weight supported by the support platform 12, and the weight of the individual will urge the rear support legs 14, 16 and front support legs 18, 20 away from each other, as indicated by the double headed arrows C and D (FIG. 2). This will urge the front support legs 18, 20 to stay at the front end 52 of the opposed grooves 42, 44, thus making the apparatus 10 stable for use. Alternatively, the front support legs 18, 20 can be secured in this operative position through positioning knobs 54, 56.

Positioning knobs 54, 56 can interact with the support platform 12 in any suitable manner for selectively engaging the front support legs 18, 20 in an operative position relative to the support platform 12. The side wall 34 of the support platform 12 and its interaction with the front support leg 18 and the positioning knob 54 is shown. For example, a spring or other biasing member can urge a shaft of the positioning knob 54 to extend through the front support leg 18 and engage side wall 34. In the operative position wherein the front support cross arm 26 contacts the front end 52 of the groove 42, the shaft of knob 54 would align with an aperture provided in the side wall 34, and the biasing member would urge the shaft 60 into the aperture to lock the front support leg 18 relative to the support platform 12. To release the front support leg 18, the positioning knob 54 would be pulled against the biasing member to remove the shaft from the aperture and thus permit movement of the front support leg 18 relative to the support platform 12. The same mechanism could be employed for the front support leg 20 for securing it to the side wall 36 through the positioning knob 56. It will, however, be appreciated that other mechanisms could be used for stabilizing the apparatus 10 in the operative position.

Upon manipulating positioning knobs 54, 56 to disengage the front support legs 18, 20 from the operative position, the front support legs 18, 20 can be pivoted to place the apparatus 10 in a storage position as shown in FIG. 5, wherein the front support cross arm 26 engages the rear end 64 of the opposed grooves 42, 44, and the support platform 12 pivots at the support platform pivot assemblies 35, 37, store the support platform 12 flush on the rear support legs 14, 16, with the opposed storage grooves 66, 68 in side walls 34, 36 accepting passage of the pivot assemblies 46, 48. In this collapsed storage position, the opposed storage feet 70, 72, which extend respectively from rear support leg 14 and rear support leg 16, can be used to place the apparatus 10 in a free standing position, as in FIG. 5. The wheels 71, 73 extend above the foot portions 39, 41, and can be used as an aid in moving the apparatus 10, particularly in the collapsed, storable position.

Top surface 50 of the support platform 12 preferably provides padding 74. A right hand grip 76 is provided extending from the front of the support platform 12, proximate the right side wall 34, and an opposed left hand grip 78 is provided extending from the front of the support platform 12, proximate the left side wall 36. When using the device, an individual will place their pelvis at the rear edge 22 of support platform 12, supporting their torso along the majority of their stomach. The upper torso will be slightly lifted so that the individual can comfortable grip the right and left hand grips 76, 78. Some individuals will find it comfortable to support themselves somewhat with their elbows on the padding 74, and others will choose to lay more fully on the padding 74. The individual will secure his legs to the pendulum assembly 80, with his hip bending freely at a position slightly rearward of rear edge 22 of the support platform to thereby enable him to move the pendulum assembly forward and rearward in a repetitive motion to perform the exercise for core muscle development. This is fully appreciated from the prior art of U.S. Pat. Nos. 5,356,359 and 6,491,607.

The pendulum assembly 80 includes a pendulum arm 82 that is secured to the rear cross support arm 24 at sleeve 84, and extends to distal end 86. A pivot arm 88 extends from proximate the distal end 86 at pivot assembly 90, and connects to the resistance transfer apparatus 92, to which it is connected through pivot assembly 94. The resistance transfer apparatus 92 preferably includes a central shaft 96 and two or more pad assemblies, such as those at 98 and 100, mounted to resistance bars, such as those at 102 and 104, extending from the central shaft 96. A foot rest 106 extends below the central shaft 96, offset from pad assemblies 98, 100. An individual will secure his legs to the pendulum assembly 80 by securing his feet between two neighboring pad assemblies, comfortably between pads. The soles of the feet will engage the foot rest 106.

A weight support 108 extends from pendulum arm 82 at selective positions between sleeve 84 and pivot assembly 90.

More particularly, the weight support 108 extends from a weight support sleeve 110 that fits around the pendulum arm 82, and a position pin 112 extends through the weight support sleeve 110 in a commonly known spring loaded or threaded fashion to be selectively engaged to a desired positioning aperture 114, 116, or 118. Other positioning apertures can be provided. A selected mass of weights 120 (FIG. 2) can be secured to weight support 108. It will be appreciated that, with a selected weight mass and selected weight positioning, various resistances can be effected in the full range of movement of pendulum arm 82 during the repetitive movement exercise. The pivot assemblies 90 and 94 permit smooth movement for individuals of various heights by allowing for movement of resistance transfer assembly 92 relative to pendulum arm 82.

In light of the foregoing, it should thus be evident that the process of the present invention, providing an apparatus for exercising core muscles, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A core muscle exercise apparatus comprising:

a support platform providing a top support surface extending between opposed sidewalls and having a front end and rear end, each of said opposed sidewalls having a support groove extending from a front groove end to a rear groove end;

a first pair of opposed support legs associated at support ends thereof with said support grooves provided in said opposed sidewalls, such that said support ends of said first pair of opposed support legs can move relative to said opposed sidewalls, from said front groove ends of said support grooves to said rear groove ends of said support grooves, said first pair of opposed support legs extending from said support ends to foot portions thereof;

a second pair of opposed support legs, each having a support end associated with a respective one of said opposed sidewalls of said support platform through a support platform pivot assembly, such that said second pair of opposed support legs can pivot at said support platform pivot assemblies relative to said support platform, said second pair of opposed support legs extending from said support ends to foot portions thereof, wherein said first pair of opposed support legs are pivotally secured to said second pair of opposed support legs at pivot assemblies provided between said support ends and said foot portions of said first and second pairs of opposed support legs; and a pendulum assembly pivotally secured to said support platform proximate a rear end thereof, said pendulum assembly comprising a pendulum arm, and at least one pad assembly; and wherein said support platform, said first pair of opposed support legs and said second pair of opposed support legs are engaged for manipulation to selectively assume an operative position and a collapsed, storable position.

2. The apparatus of claim 1, wherein, in said operative position:

said support ends of said first pair of opposed support legs are secured to said support platform proximate said front groove end of said support groove and said foot portions of said first pair of opposed support legs engage a ground surface, said foot portions of said second pair of opposed support legs engage said ground surface, and said top surface of said support platform is held substantially horizontal to said ground surface.

3. The apparatus of claim 2, wherein said support platform includes opposed storage grooves in its opposed sidewalls, and, in said collapsed, storable position:

said support ends of said first pair of opposed support legs are positioned at said rear groove end of said support groove; and said support platform is pivoted at said support platform pivot assemblies to rest said support platform on said second pair of support legs, with said pivot assemblies provided between said support ends and said foot portions of said first and second pairs of opposed support legs being received in said opposed storage grooves of said support platform.

4. The apparatus of claim 3, wherein said first pair of support legs include wheels for aiding in the movement of the apparatus in its collapsed, storable position.

5. The apparatus of claim 4, wherein said second pair of support legs include storage feet extending therefrom, proximate said foot portions, said storage feet functioning with said foot portions to permit the apparatus to be free standing in its collapsed, storable position.

* * * * *